US005398367A

United States Patent [19]

Lu

[11] Patent Number: 5,398,367

[45] Date of Patent: Mar. 21, 1995

[54] TOOTHBRUSH WITH BOTH SOFT AND HARD BRISTLES

[76] Inventor: Guixian Lu, 97 Dresden, Pontiac, Mich. 48340

[21] Appl. No.: 172,765

[22] Filed: Dec. 27, 1993

[51] Int. Cl.[6] ..... A46B 9/04

[52] U.S. Cl. ..... 15/167.1; 15/DIG. 5

[58] Field of Search ..... 15/167.1, DIG. 5, DIG. 6

[56] References Cited

U.S. PATENT DOCUMENTS

| | | | |
|---|---|---|---|
| 335,345 | 1/1886 | Estabrook | 15/167.1 |
| 1,382,681 | 6/1921 | Segal | 15/167.1 |
| 2,080,605 | 5/1937 | Duey | 15/167.1 |
| 2,849,740 | 9/1958 | Pauker | 15/DIG. 5 |
| 3,103,679 | 9/1963 | Clemens | 15/DIG. 6 |
| 3,263,258 | 8/1966 | Burge | 15/167.1 |
| 3,624,667 | 11/1971 | Muhler | 15/167.1 |
| 4,268,933 | 5/1981 | Papas | 15/167.1 |
| 4,403,623 | 9/1983 | Mark | 15/167.1 |
| 4,472,853 | 9/1984 | Rauch | 15/DIG. 6 |
| 4,672,706 | 6/1987 | Hill | 15/167.1 |
| 4,766,633 | 8/1988 | Clark | 15/167.1 |
| 5,027,463 | 7/1991 | Daub | 15/167.1 |
| 5,114,214 | 5/1992 | Barman | 15/DIG. 5 |

FOREIGN PATENT DOCUMENTS

| | | | |
|---|---|---|---|
| 557790 | 8/1923 | France | 15/167.1 |
| 2728672 | 1/1979 | Germany | 15/167.1 |
| 3524586 | 1/1987 | Germany | 15/DIG. 5 |
| 355452 | 2/1938 | Italy | 15/167.1 |
| 1083369 | 9/1967 | United Kingdom | 15/167.1 |

*Primary Examiner*—Mark Spisich

[57] ABSTRACT

A toothbrush comprises both soft and hard bristles. The soft bristles are longer while the hard bristles are shorter. With less force, only the soft bristles are used, giving minor cleaning and gum massaging. With stronger force, the hard bristles will be used, giving more effective cleaning, especially the space between the teeth. The hard bristles are implanted away from the edge of the bristle pattern so they are kept from being bent outward. Some bristles at the edge of the pattern are cut shorter to give the hard bristles a chance to get into space between the teeth.

1 Claim, 1 Drawing Sheet

TOOTHBRUSH WITH BOTH SOFT AND HARD BRISTLES

BACKGROUND OF THE INVENTION

1. Field of the Invention

The present invention relates to a toothbrush comprising both soft and hard bristles, a toothbrush that can act as both soft and firm toothbrush.

2. Description of Prior Art

The toothbrushes on the market nowadays are classified into three categories: Soft, medium and firm according to the degree of hardness of the bristles.

Firm toothbrushes, having hard bristles, clean plaque better. They have two drawbacks:

a. The hard bristles may hurt gums.

b. Outward bent hard bristles of an old toothbrush may hurt the membrane inside the mouth while brushing the teeth.

However, the problem with soft toothbrushes is that they are unable to clean the space between the teeth effectively. Bristles of soft toothbrushes are either unable to be inserted into the narrow space between the teeth, or are unable to remove plaque after they are inserted there. Efforts were made in U.S. Pat. Nos. 3,934,298, 4,633,542, 4,72,4569, 5,184,368, and 4,694,844 to get better access between the teeth. None of them have bristles hard enough for cleaning, especially the space between the teeth.

Medium toothbrushes cannot meet all these needs because some teeth need harder cleaning, others need minor cleaning, while gums need just a massaging.

SUMMARY OF THE INVENTION

An object of the present invention is to provide a novel toothbrush comprising both soft and hard bristles. The invention provides hard bristles for cleaning the teeth more effectively, especially the space between the teeth, where and when it is needed. The invention also provides an option to use only soft bristles to maximize the comfortableness and gum massaging effects.

Another object of the invention is to use the soft bristles for getting a feedback message of the current position of the toothbrush so that the toothbrush will be moved away from the gums to teeth before the Hard-Short Bristles are used.

Lastly, a further object of the invention is to position soft bristles at the edge of the bristle pattern to prevent the hard bristles from bending outward and hurting the membrane of the mouth.

For this purpose, the invention provides a toothbrush comprising at least three kinds of bristles: Hard-Short Bristles, Soft-Long Bristle and Soft-Short Bristles. The Soft-Long Bristles are thinner in diameter and longer in length, while the Hard-Short Bristles are thicker and shorter. The Soft-Short Bristles are thinner and shorter. It also provides a strategy of patterning the bristles. In the preferred embodiment, the bristle pattern have three kinds of areas: Soft Areas, Hard Areas and Edge Areas. The Soft Areas comprise Soft-Long Bristles. The Hard Areas comprise Hard-Short Bristles. The Edge Areas comprise Soft-Short Bristles. With less force on the toothbrush, only the Soft-Long Bristles clean teeth or massage gums. With stronger force on the toothbrush, the Hard-Short Bristles will touch and clean the teeth. Therefore, the Hard-Short bristles can be applied optionally to some teeth that need harder cleaning. The Edge Areas prevent Hard-Short Bristles from bending outward and hurting the membranous tissue lining inside of the mouth. Therefore, these areas are always implanted at the edge of the bristle pattern and adjacent to Hard Areas. The reason of making the bristles in these areas shorter is to let the free ends of the Soft-Short Bristles leave the space between the teeth before the Hard-Short Bristles reach there so that the Hard-Short Bristles can clean the space between the teeth. Because Soft-Long Bristles always touch teeth or gums before the Hard-Short Bristles, the touching message given by the Soft-Long Bristles can be used by the nerve as a feedback to guide the movement of the toothbrush so that the Hard-Short Bristles would not touch and hurt the gums.

IN THE DRAWING

Figure 3:
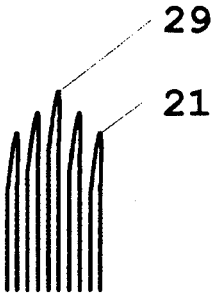

FIG. 3. shows the bristles of different length in one of the tufts in the Hard Areas.

DETAILED DESCRIPTION OF THE PREFERRED EMBODIMENT

The toothbrush according to the present invention is formed by implanting bristles made of two diameters of Nylon into a handle 100.

In the preferred embodiment, the Soft-Long Bristles are of 0.44 inches in length and 0.006 inch in diameter; the Hard-Short Bristles are between 0.25 inches and 0.3 inches in length and of 0.02 inches in diameter, and are tapered at the free ends so that they can clean the teeth better especially the space between the, teeth, with less abrasion and irritation. Soft-Short Bristles are of 0.3 inches in length and 0.006 in diameter.

Figure 1:
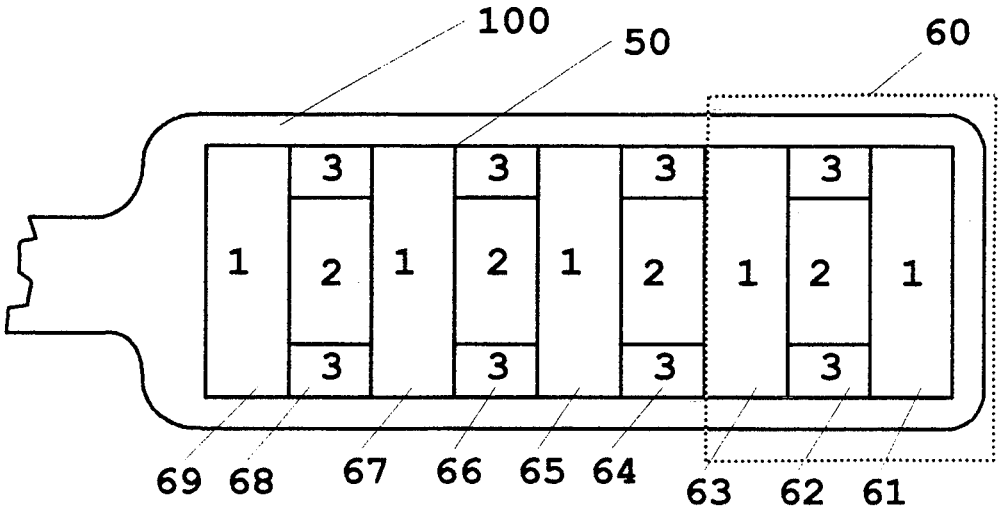
FIG. 1 is the bristle pattern showing Soft Areas, Hard Areas, and Edge Areas.

FIG. 1 shows the bristle pattern 50 in the preferred embodiment. There are five Soft Areas 1 implanted in every other row of the tufts into the handle, crosswise in the pattern (row 61, row 63, row 65, row 67 and row 69). There are eight Edge Areas 3 implanted in the edge of the pattern, in the rest of the rows (row 62, row 64, row, 66 and row 68). There are four Hard Areas 2 implanted in the same rows as Edge Areas.

Figure 2:
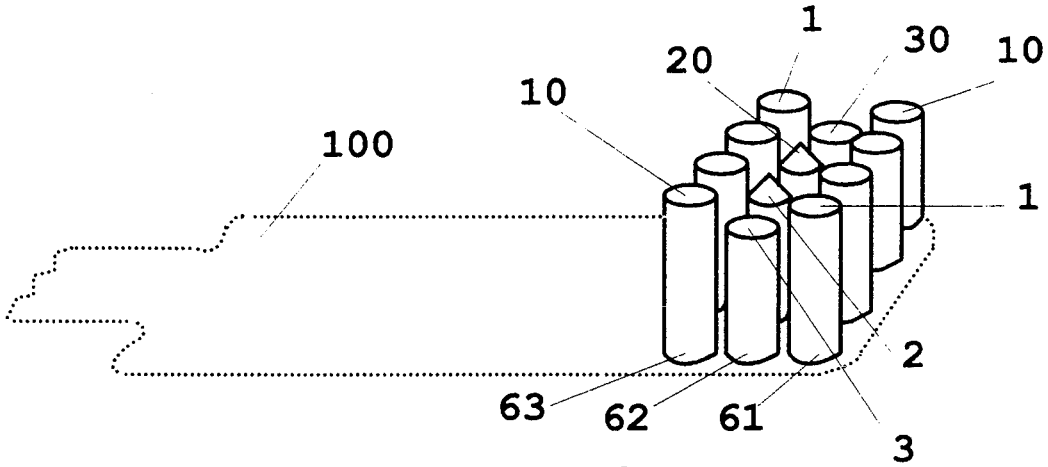
FIG. 2 is a fragmentary perspective view of the toothbrush showing the tufts in the areas inside the rectangle indicated by the dashed lines in FIG. 1.

FIG. 2 shows the tufts in the areas circled by the dashed line 60 in FIG. 1. In FIG. 2, there are two Soft Areas 1, one Hard Area 2 and two Edge Areas 3. It can be seen that each Soft Area 1 has four tufts 10 which comprise Soft-Long Bristles. Each Hard Area 2 has two tufts 20 which comprise Hard-Short Bristles. Each Edge Area 3 has one tuft 30 which comprises Soft-Short Bristles.

Fig. 3 shows the Hard-Short Bristles in one tuft. They are of different length and tapered at the free end. The longest is numerated by 29 and located in the center of the tuft. The shortest is numerated by 21 and located in the edge of the tuft. The tapered bristles of different length can clean the space between the, teeth better.

When less force is applied on the toothbrush, only Soft-Long Bristles in Soft Areas 1 clean the teeth and massage the gums. When some place, such as the space between teeth, needs harder cleaning, the toothbrush will be moved to the place by the guide of the Soft-Long Bristles, and stronger force will be applied to the toothbrush so that the Hard-Short Bristles in areas 2 will touch the place and clean it harder. Since the toothbrush should move up and down to clean the teeth, the bristles in Edge Areas 3 always get into the space between the teeth before the Hard-Short Bristles. Therefore the bristles in Edge Areas 3 are made shorter so that they get out of the space between the teeth before the Hard-Short Bristles in areas 2 reach there, letting them clean the space. It also can be seen from FIG. 2 that the bristles in the Edge Areas 3 prevent the Hard-Short Bristles in areas 2 from bending outward and hurting the gums.

The foregoing description of the preferred embodiments of the invention has been presented for the purposes of-illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A toothbrush comprising:

a.) an elongated handle having an elongated head attached to an end thereof and which is in alignment with said handle:

b.) a plurality of bristles extending from a surface of said head, said plurality of bristles including:

i.) a plurality of first bristles having a first length and a first diameter and which are disposed on said head in a plurality of parallel rows spaced along the length of the head wherein the rows are transverse with respect to the longitudinal axis of the handle;

ii.) a plurality of second bristles having a second length which is less than said first length, said plurality of second bristles being disposed on said head in a plurality of parallel rows spaced along the length of the head wherein the rows are transverse with respect to the longitudinal axis of the handle, the rows of second bristles being located between adjacent rows of the first bristles, said second bristles including a first group of second bristles, which have a diameter greater than said first diameter and a second group of second bristles which have a diameter less than the diameter of the bristles of the first group, the bristles of the second group being located at opposite end portions of the rows of second bristles;

c.) whereby said first bristles are adapted to clean the teeth when ordinary pressure is applied and wherein they are adapted to bend when greater pressure is applied to permit the second bristles to contact the teeth, the second group of second bristles are adapted to prevent the first group of second bristles from bending outward towards side portions of said head so as to permit the second group of second bristles to clean the space between the teeth.

* * * * *